United States Patent [19]

Mattson

[11] 4,333,433

[45] Jun. 8, 1982

[54] ELECTRONIC IGNITION SYSTEM WITH MECHANICAL ADVANCE

[75] Inventor: Richard W. Mattson, Rossford, Ohio

[73] Assignee: Eltra Corporation, Toledo, Ohio

[21] Appl. No.: 130,898

[22] Filed: Mar. 17, 1980

[51] Int. Cl.[3] ..... F02P 5/04; F02P 7/02

[52] U.S. Cl. ..... 123/420; 123/146.5 A; 123/617; 200/310; 310/70 R

[58] Field of Search ..... 123/146.5 A, 595, 617, 123/420; 200/19 R, 19 A, 19 M, 31 CA; 64/25; 310/70 R, 70 A

[56] References Cited

U.S. PATENT DOCUMENTS

| | | | |
|---|---|---|---|
| 1,967,445 | 7/1934 | Mallory | 64/25 X |
| 2,167,694 | 8/1939 | Spengler | 200/31 CA |
| 3,447,004 | 5/1969 | Falge | 200/19 M X |
| 4,037,577 | 7/1977 | Gallo | 123/617 X |

FOREIGN PATENT DOCUMENTS

| | | | |
|---|---|---|---|
| 1034187 | 7/1978 | Canada | 123/595 |

*Primary Examiner*—Tony M. Argenbright
*Attorney, Agent, or Firm*—James P. DeClercq

[57] ABSTRACT

A mechanical structure for an ignition controller (20) for an electronic ignition system, including structure for a sensing coil carrier, a trigger rotor, and a mechanical advance mechanism is disclosed. The sensing coil carrier (28) is pivotably mounted to a shaft (22) of the ignition controller (20), and holds a sensing coil (30) a fixed radial distance from the shaft. A trigger rotor (26) having a generally circular configuration with two circumferential walls (90, 92) forming a groove, with a metallic channel member (96) embedded in the groove, is fixed to the shaft (22), so that the sensing coil carrier (28) and the trigger rotor (26) are both referenced to the same axis. The mechanical advance mechanism (24) uses identical springs (60) for primary advance, and a self centering spring (66) for secondary advance, thereby eliminating unbalanced loading that results in hysteresis in ignition advance. Advance weights (54) are fitted with involute gear teeth (114), mating with teeth on the trigger rotor, to provide an ignition advance utilizing rolling contact for minimum friction and wear. The disclosed embodiment of the invention is adapted for use on a motorcycle, and does not include a distributor mechanism, although such a mechanism maybe easily incorporated for use on a automobile engine.

11 Claims, 10 Drawing Figures

ELECTRONIC IGNITION SYSTEM WITH MECHANICAL ADVANCE

FIELD OF THE INVENTION

This application relates to electronic breakerless ignition systems. In particular, this application relates to mechanical structure for an ignition controller for an electronic ignition system, including structure for a sensing coil carrier, a trigger rotor, and a mechanical advance mechanism.

BACKGROUND OF THE INVENTION

Ignition systems without breaker points for use with internal combustion engines are well known. Such systems provide an ignition impulse causing a spark in one or more cylinders by either discharging a capacitor to cause a sudden flow of electrical current through the primary of an ignition coil, or by interruption an electrical current through the primary of the ignition coil to discharge its magnetic field, to cause an ignition impulse in the ignition coil secondary. Such systems provide an ignition impulse at a proper time by sensing the position of a rotating element of the internal combustion engine, and providing an ignition advance either electronically or mechanically.

Conventionally, a timing rotor is rotated past a sensing coil or pickup. The trigger rotor is a spider-shaped device, having a plurality of arms, corresponding to the number of cylinders of the internal combustion engine to be operated, the arm being conductive for use with sensing coils, or opaque, for use with photo-electric pick-up. Such spider-shaped structures are conventionally made by molding, by sintering, stamping, or by metal plating on a molded plastic structure. Such interrupted structures are difficult to fabricate, being subject to warpage during forming, as well as having other difficulties corresponding to the method of manufacturing. For example, stamping and sintering both become more difficult when depth and thickness ratios between ajoining elements become large. Metallic plating on non-conductive rotating elements may peel off.

Establishing and maintaining relative positioning of a trigger rotor and sensing element is also difficult. It is particularly difficult in applications where the trigger rotor and sensing coil are moved in respect to each other in the process of establishing initial engine timing, such as with internal combustion engines such as used on some motorcycles.

The use of mechanical advance systems is also known. Such advance systems may include centrifugal weights, which have pins which slidably protrude through a plate attached to a breaker point cam, or a cam-shaped element, for use with an electronic ignition system pickup coil, or have protrusions from centifugal weights which slide in a groove in the member carrying the cam. In order to obtain a dual-sloped advance, unequal springs on two weights are conventionally used. One spring is selected so that is always restrains one weight, while another spring is selected so that it begins to restrain the other weight after the engine reaches a predetermined speed, giving an ignition advance dependent on only one spring up to a predetermined speed. In practice, this means that, below the predetermined speed, one spring is restraining both the weight to which it is attached and the weight that is not yet being restrained by the second spring. This creates frictional forces, which leads to hysteresis, or, a different amount of advance for a given engine speed when the engine is decelerating than when it is accelerating.

Therefore, it is the first objective of the invention to provide a structure for an ignition controller which insures and maintains correct positioning between a trigger rotor and a sensing coil. It is a feature of this first objective that a stationary carrier for the sensing coil rotatably engages the rotating shift which carries the trigger rotor, whereby the trigger rotor and the sensing coil are referenced to the shaft and to each other. It is advantage of this first objective that the radial relationship between the trigger rotor and sensing coil cannot be disturbed when the sensing coil is moved angularly to establish initial ignition timing.

It is a second objective to provide a trigger rotor in the form of a disk with two protruding parallel walls forming a groove, with a conductive element disposed within the groove. It is a feature of this second objective that a metallic element disposed within the groove is a generally U-shaped metal channel member comforming to, and embedded in, the surface of the disk and two walls. It is an advantage of this trigger rotor that it is without separate arms which may strike and damage a sensing coil, particularly when the rotor and sensing coil are manually moved with respect to each other, a further advantage being that the trigger rotor is relatively easy to manufacture by molding, with as many metal channel members as desired being placed in a mold before injection of plastic, thereby being adaptable to an engine with any numbers of cylinders, as well as being resistant to warpage during or after manufacture.

It is a third objective of the invention to provide an advance mechanism which utilizes a rolling contact between elements to reduce frictional wear. It is a feature of this objective that rolling contact is produced by providing a projection on centrifugal weights in the form of a gear tooth, cooperating with gear teeth formed in the trigger rotor. This produces the advantage that long life and accurate ignition advance can be obtained.

It is further objective of the invention to provide a spring arrangement for a centrifugal advance mechanism that does not provide unequal forces. It is a feature of this objective that two weights are provided with substantially identical restraining springs, active simultaneously, the weights being further restrained by a separate, self centering, dual-ended spring which is contacted by the centrifugal advance weights when the associated engine reaches a predetermined speed. The advantage of this spring arrangement is the elimination of non-symmetrical forces which cause hysteresis in advance curves, and also provides independent control over the slope of the advance curve above a predetermined speed.

DESCRIPTION OF THE PREFERRED EMBODIMENTS

Figure 1:
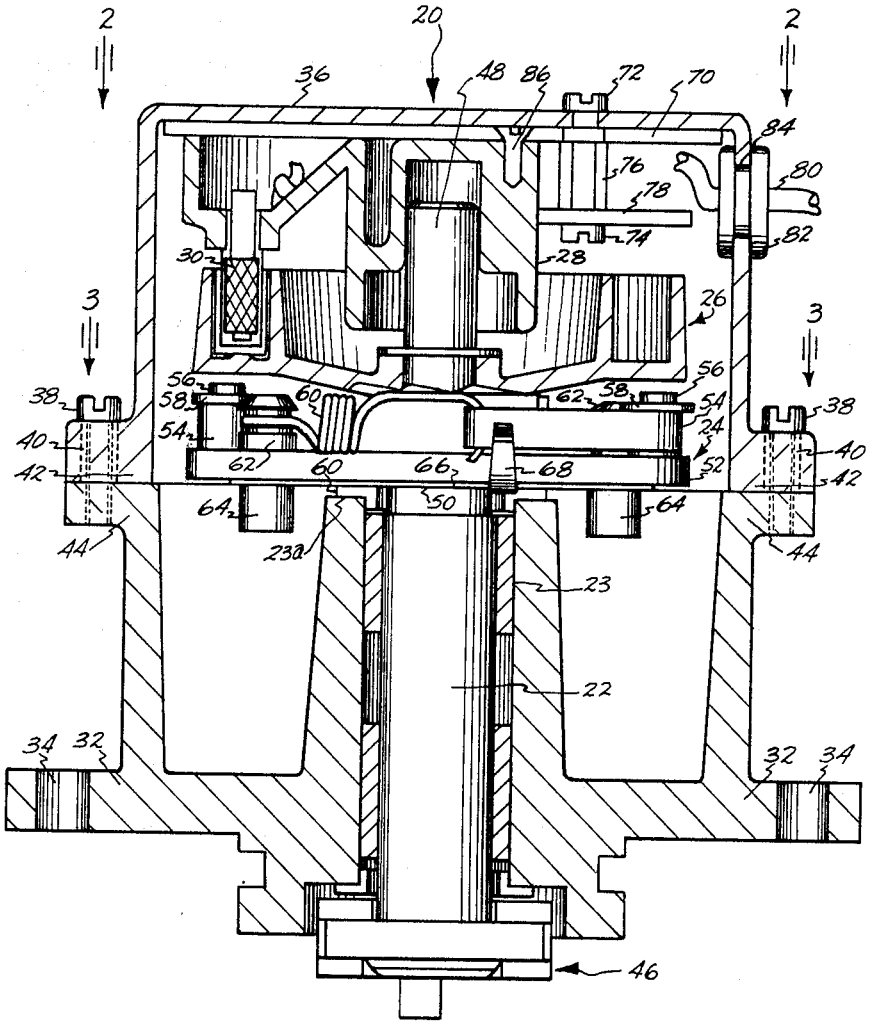
FIG. 1 is a side elevational view, partially in section, showing an ignition controller according to the preferred embodiment of the invention.

It should be noted that, while the embodiment illustrated is suited best for the use on a motorcycle engine, the concepts and structures disclosed have application, with or without minor modification, to automobile engines having any desired number or cylinders. For instance, should a conventional distributor be desired, the advance mechanism and/or trigger rotor may be used without substantial modification, while the sensing coil or pickup carrier would be modified to be positioned further down the rotatable shaft, and restrained from motion either by a projection from the distributor cap, or any other suitable method. Also, the novel trigger rotor may be used in conventional distributor-type electronic ignition systems provided with electronic advance, such as by mounting the sensing coil, or coil and carrier, to a base plate of the distributor, and inverting the trigger rotor from the position illustrated in the drawings, to allow room for positioning a conventional rotor on the rotatable shaft. An electronic ignition circuit may be mounted in the base of a distributor, or mounted externally, rather than mounted in a cap member, as shown.

Now, referring particularly to the drawings, FIG. 1, shows an ignition controller according to the invention, adapted for use on a motorcycle. The ignition controller 20 includes a rotatable shaft 22, in a bore 23 with a shoulder 23*a* and advance mechanism 24 attached to the shaft, and a trigger rotor 26 rotatably mounted to the shaft 22 and circumferentially movable about shaft 22 by advance mechanism 24. A sensing coil carrier 28 is rotatably located by a shaft 22, and maintains a sensing device such as coil 30 in a fixed radial relationship with shaft 22 and with trigger rotor 26.

Ignition controller 20 includes a base portion 32, which is attached to an engine, not shown, by bolts passed through apertures 34. A cover member 36 is attached to base portion 32 by means of screws 38 passed through elongated slots 40 in tabs 42 of cover 36, into threaded holes in tabs 44 of base portion 32, so that cover 36 may be rotated with respect to base portion 32 to set initial ignition timing for an engine. Shaft 22 is rotated in synchronism with an output shaft of an engine by means of a coupling 46. In the preferred embodiment of the invention illustrated, coupling 46 is a Oldham-type coupling, which mates with an output shaft, not shown, of the engine.

In the embodiment of the invention illustrated, shaft 22 has a stepped portion 48, and a shoulder 50 separating stepped portion 48 from the remainder of shaft 22. A base plate 52 of advance mechanism 24 is joined to shaft 22 at shoulder 50, preferably by welding, and rotates with shaft 22. Centrifugal weights 54 are rotatably mounted to base plate 52 by means of pins 56 pressed in apertures, not shown, in base plate 52, and retained by snap rings 58 on pins 56. The centrifugal weights 54 are restrained by identical springs 60, attached to weights 54 and to pins 62, pressed in apertures, not shown, in base plate 52. Pins 62 have bottom portions 64 which pass through apertures in spring 66, to rotationally restrain spring 66, with spring arms 68. Portions 64 may be enlarged, or provided with caps or the like, to hold spring 66 adjacent plate 52. In the preferred embodiment, spring 66 is entrapped between plate 52 and thrust washers 67, which rest on shoulder 23*a* of bore 23. As will be further described below, spring clip 66 is free to move a limited amount with respect to base plate 52, to allow spring arms 68 to make equal contact with weights 54 when weights 54 are pivoted outwardly due to centrifugal force.

In the embodiment illustrated, a plate 70 is attached to cover 36 by fastening means such as screws 72 and 74. A threaded spacer 76 is placed on the body of screw 72, and retains a printed circuit board 78 within cover 36 by entrapping it between spacer 76 and screw 74. Printed circuit board 78 is used to mount components, not shown, for an electronic ignition system providing an integral ignition controller, requiring only a wire suppling power to the system, and a wire connected to a ignition coil, or the like, for providing an ignition pulse to the associated engine. These wires are shown as wires 80, passing through grommet 82 in aperture 84 in cover 36.

In the embodiment illustrated, carrier 28 is attached to plate 70. As will be apparent, a means for preventing carrier 28 from rotating need not perform any other function. In the illustrated embodiment, fastener means such as screws 86 attach plate 70 and carrier 28.

Figure 2:
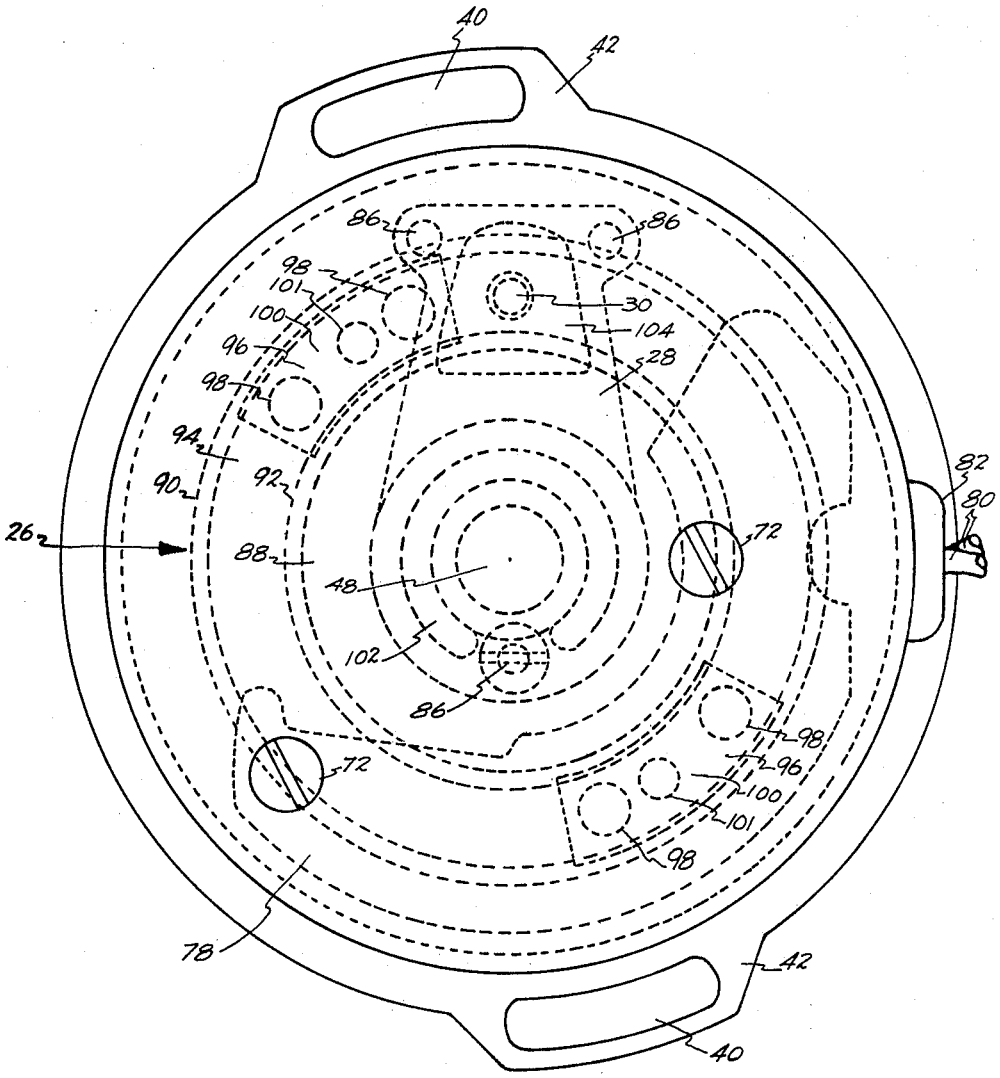
FIG. 2 is a top elevational view, partially in section, of the ignition controller of FIG. 1.
Figure 8:
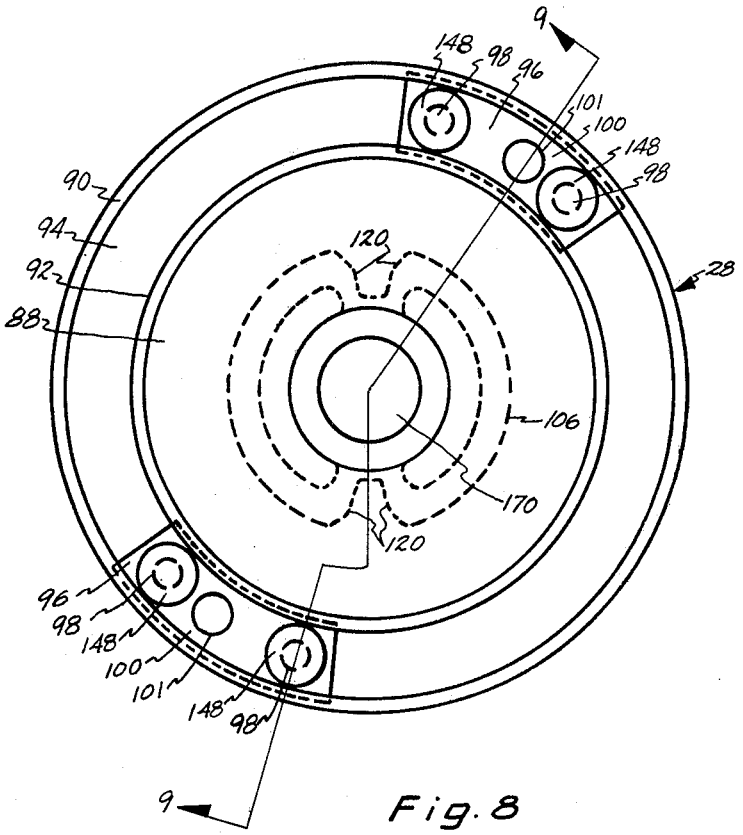
FIG. 8 is a top elevational view of a trigger rotor according to the invention.
Figure 9:
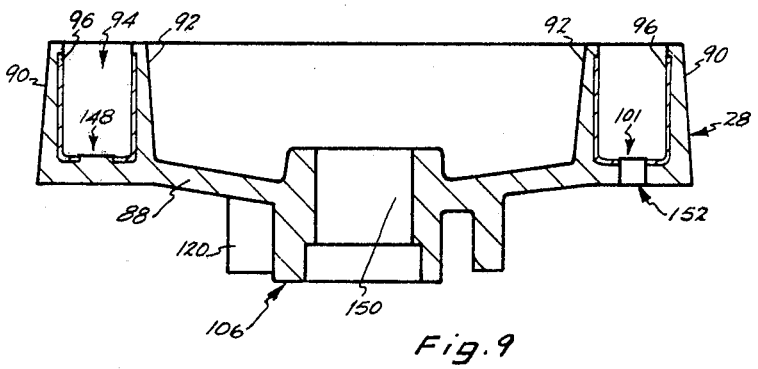
FIG. 9 is a sectional view of a trigger rotor according to the invention, taken along line 9—9 in FIG. 8.

As shown in FIGS. 2, 8 and 9, trigger rotor 26 has a generally disk-shaped portion 88, with an outer wall 90 and an inner wall 92 concentrically arranged near its periphery, and forming an annular groove 94 between walls 90 and 92. Conductive members, or the like, shown as metallic channels 96, are disposed in groove 94 when rotor 28 is molded, and are embedded in a portion of the inner surface of wall 90, a portion of the outer surface of wall 92, and a portion of disc member 99 forming the bottom of groove 94. As will be apparent, trigger rotor 26 rotates, channel members 96 passing coil 30, and changing the electromagnetic characteristics of the coil, causing an ignition signal.

Channel member 96 are firmly held in position by means of plastic flow of the material of rotor 26 through apertures 98, covering a portion of inner surface 100 of channel members 96. Obviously, the inner surface 100 of a channel member 96 is co-planar with the adjacent portion of the surface of disc member 88 forming the bottom of groove 94. Channel members 96 are circumferentially and radially located during the manufacture of rotor 26 using locating holes 101, for locating pins, not shown, in a mold, not shown, for forming rotor 26. In the preferred embodiment, rotor 26 is formed by injection molding of a plastic material, around clips 96.

In the embodiment illustrated, carrier 28 is formed with cavities, where strength is not required, to reduce the amount of the material necessary. Carrier 28 has a partially circumferential cavity 102, and a cavity 104 adjacent coil 30. This savings in material is possible since there is no danger of a sensing means such as coil 30 being struck by an arm of a spider-shaped trigger rotor during adjustment of an ignition system, or otherwise, the trigger rotor and pickup carrier being located with respect to the same shaft in according with the invention.

Figure 3:
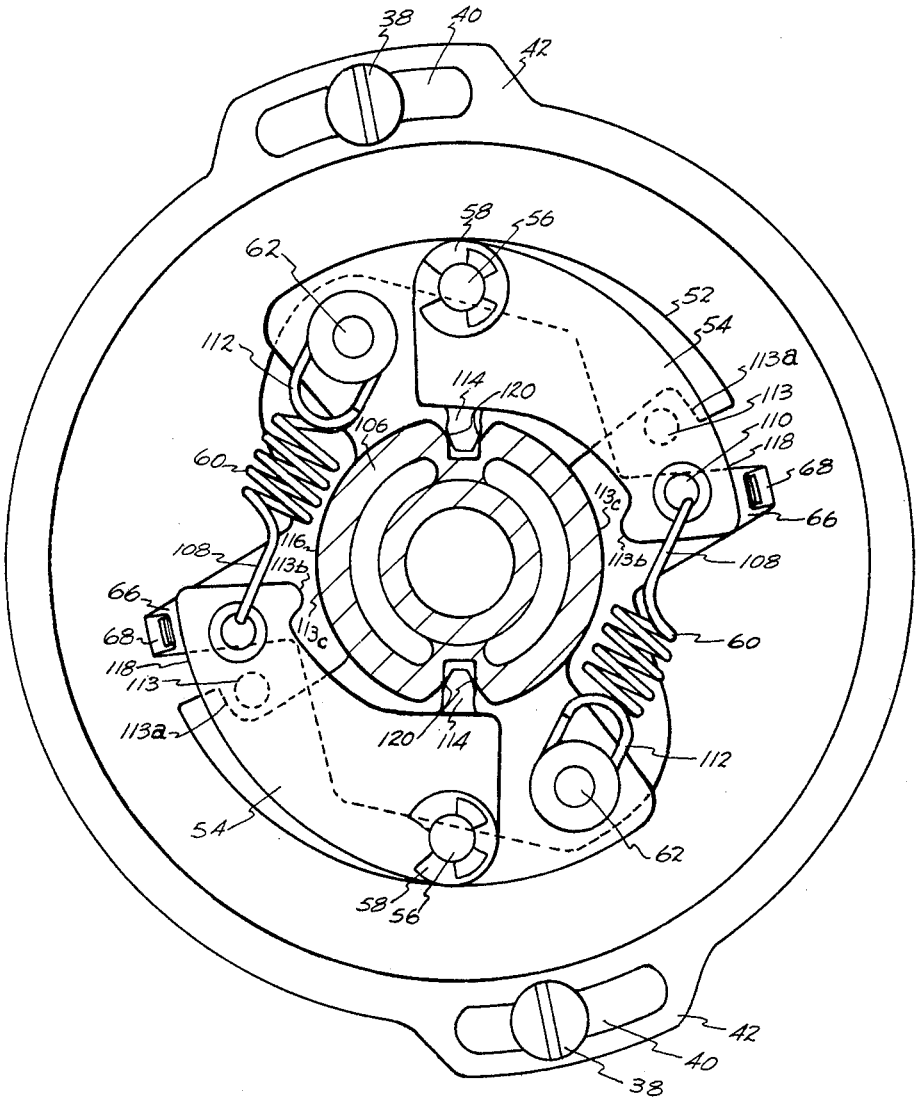
FIG. 3 is a top view partially in section showing the operation of the advance mechanism, taken along line 3—3 in FIG. 1.

FIG. 3 is a sectional view taken through the hub portion 106 of rotor 26, and shows the operation of the advance mechanism in a partially advanced position. As stated above, weights 54 are pivotably mounted on pins 56, and rotate outwardly around pins 56 under centrifugal force caused when shaft 22 is rotated. They are restrained by springs 60 having looped ends 108 passing through apertures 110 in weights 54. Springs 60 are provided with elongated closed loops 112, to facilitate their mounting on pin 62. Pin 62 is provided with an annular groove, not shown, and loop 112 is forced over pin 62 until it is engaged by the annular groove.

Weights 54 drive hub 106 of trigger rotor 28 through involute driving surfaces. Projections 114 of weights 54 are formed as involute gear teeth, and engage involute gear teeth in the surface 116 of hub portion 106.

As weights 54 pivot outwardly around pins 56, gear tooth projections 114 of weights 54 roll against hub 106 of rotor 26, causing rotor 26 to move with respect to shaft 22, creating an ignition advance.

In the illustrated embodiment, stop pins 113 on weights 54 contact surfaces 113*a* of plate 52 to determine maximum ignition advance. Projections 113*b* on weights 54 contact surfaces 113*c* of hub 106 to determine minimum advance.

An advance curve for an ignition controller must be matched to the engine requirements. Often, a dual-rate ignition advance is desired. In conventional ignition system, such a dual-rate ignition advance is achieved with unequal springs, with the results described above. In accordance with the invention, a spring 66, loosely mounted to base plate 52, is positioned so that it will be contacted by portions 118 of weights 54 as weights 54 pivot outwardly under the influence of centrifugal force. Spring 66 then acts as a secondary spring, spring arms 68 making contact with portions 118, and creating an additional force against weights 54, when rotational speed of shaft 22 exceeds a predetermined rate. In other words, spring 66 serves as a secondary spring, allowing a dual-slope advance curve without incurring the disadvantages of conventional advance mechanisms.

Figure 4:
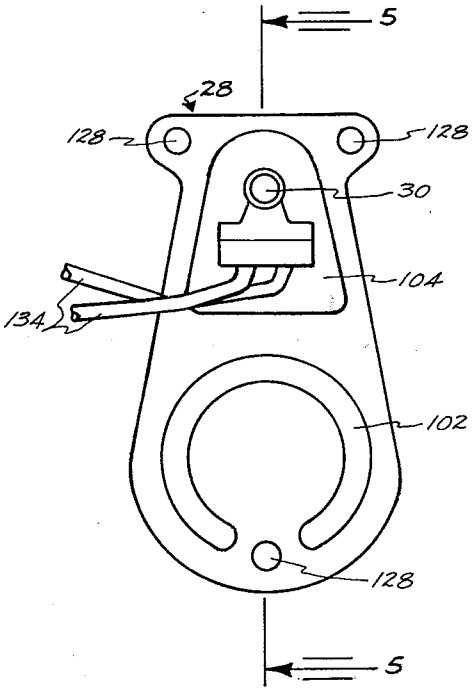
FIG. 4 is a top perspective view of a pickup carrier according to the invention.
Figure 5:
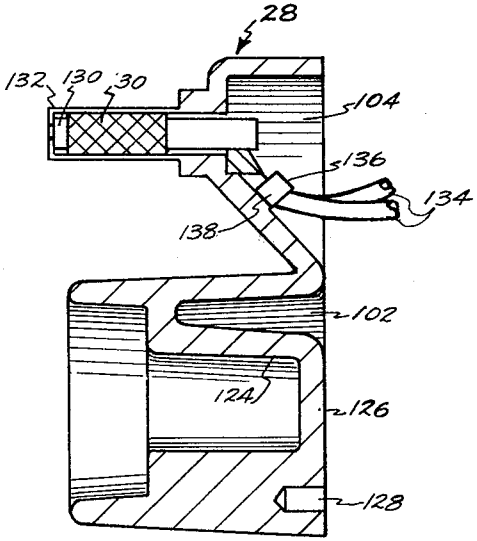
FIG. 5 is a sectional view of a pickup carrier according to the invention taken along line 5—5 in FIG. 4.

FIGS. 4 and 5 illustrate a sensing coil carrier according to the preferred embodiment of the invention. Carrier 28 includes a bore 124 for receiving portion 48 of shaft 22. Obviously, portion 126, closing bore 124 in the illustrated embodiment, could be removed to allow the use of sensing coil carrier 28 in connection with a distributor-type ignition system as described above. The illustrative embodiment is provided with threaded apertures 128, cooperating with screws 86 for mounting carrier 28 to plate 70. Coil 30 is mounted in bore 130 of a protrusion 132 of carrier 28. Bore 130 and bore 124 are parallel to each other. In the preferred embodiment, coil 30 is retained in bore 130, and is provided with wires 134 for connection to an ignition circuit, as will be described below. As will be apparent, bore 130 maintains coil 30 at the same distance from the center line of shaft 22 as the distance from groove 94 of trigger rotor 26 from the center line of shaft 22. In the embodiment illustrated, a snap-on clamping means 136 is used to support wires 134, and is preferably mounted to portion 138 of carrier 28 at the time coil 30 is mounted in bore 130. Preferably, clamping means 136 and portion 138 are both provided with grooves for positioning and retaining wires 134. In the preferred embodiment, cavity 104 is filled with potting compound to further support wires 134 to prevent any possibility of movement of wires 134 connected to coil 30, preventing fatigue and subsequent breaking of wires 134. Cover portion 36 may be filled with potting compound to cover printed circuit board 78, maintaining the integrity of all components thereon.

Figure 6:
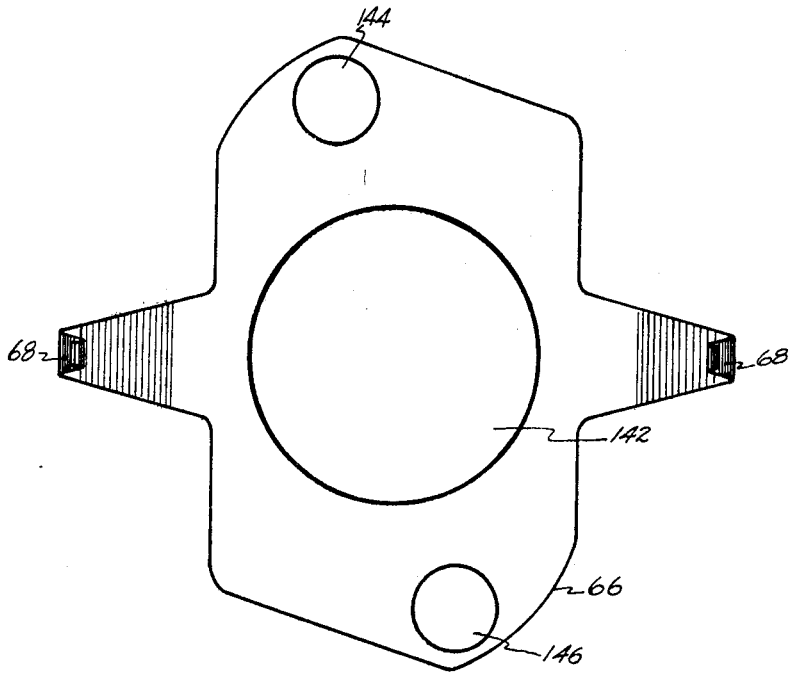
FIG. 6 is a top elevational view of a spring according to the invention.
Figure 7:
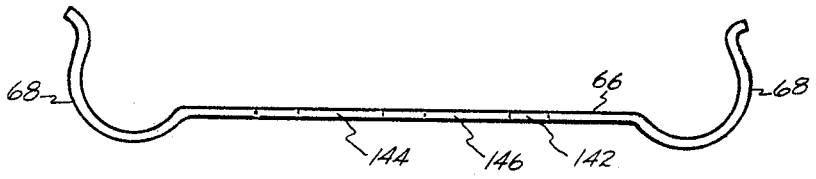
FIG. 7 is a side elevational view of a spring according to the invention.

FIGS. 6 and 7 are views of secondary spring 66, which has spring arms 68 for contacting weights 54. Spring 66 has a large central aperture 142, larger than the diameter of shaft 22, which passes through aperture 142. Spring 66 is also provided with a first aperture 144 and second aperture 146, adapted to receive pins 62. In the preferred embodiment, aperture 144 is smaller than aperture 146. Therefore, when portions 118 of weights 54 contact arms 68, spring 66 will move to equalize the forces exerted by arms 68 both by linear motion about pins 62 passing through aperture 144 and 146, and by a pivoting motion about the pin 62 passed through aperture 144, as required.

FIGS. 8 and 9 illustrate a trigger rotor according to the invention. As shown, trigger rotor 28 has a central aperture 150 for closely and rotatably receiving portion 48 of shaft 22, a hub portion 106 including gear teeth 120 for cooperating with advance mechanism 24, a disk portion 88, and outer and inner walls 90 and 92 protruding from the disk, forming groove 94. Disk portion 88, in an actual physical embodiment, has a slight conical shape, primarily for convenience in manufacture and assembly.

In the preferred embodiment, channel member 96 is formed with trigger rotor 28 by being placed over a locating pin of a mold, not shown, which passes through hole 101 of channel member 96. Subsequently, the mold is closed, and a plastic resin is injected, flowing around channel member 96, forming locking protrusion 148, to firmly retain channel member 96. As shown in FIG. 9, the locating pin also forms an aperture 152 in the body of rotor 28.

In the illustrated embodiment, rotor 28 is provided with two channel members 96, for use with a 2-cylinder engine, an ignition signal being provided each time a channel member 96 passes coil 30. It should be noted that the illustrated embodiment could also be used for a 4-cylinder engine, using an ignition system of the type disclosed in U.S. Pat. No. 3,605,714, issued to J. T. Hardin et al on Sept. 20, 1971, hereby incorporated by reference. It will be obvious that, for a instance, eight channel members 96 could be provided in a trigger rotor 28 according to the invention for use in a conventional high tension distributor for an 8-cylinder engine.

Figure 10:
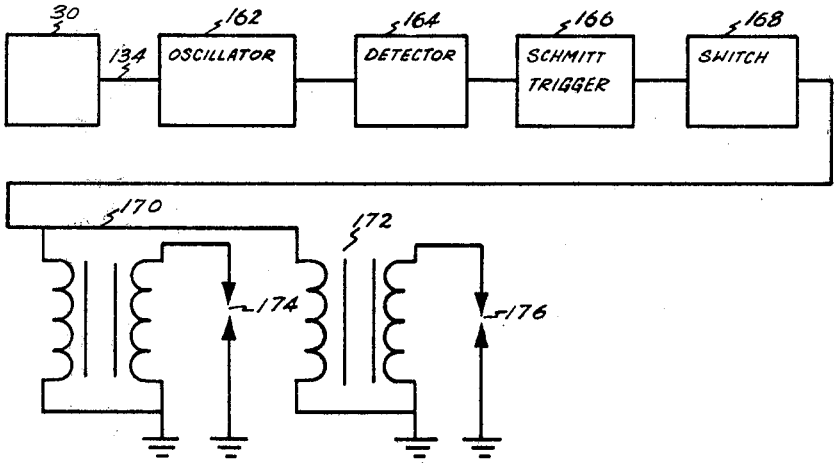
FIG. 10 is a block diagram of an ignition system usable with the illustrated structure for an ignition controller.

FIG. 10 is a schematic illustration of an ignition system used with an actual physical embodiment of an ignition controller 20 according to the invention, on a motorcycle. In the embodiment illustrated, wires 134 connect coil 30 to an oscillator 162. Preferably, the oscillator is a starved-feedback type, with coil 30 forming part of the resonant circuit, so that the amplitude of the oscillation of oscillator 162 is changed when the Q of coil 30 is effected by proximity to a channel member 96 or the like. Oscillator 162 is connected to a detector 164, converting the output of oscillator 162 to a first voltage level when coil 30 is not in proximity to a channel member 96, and a second, lower, voltage level when coil 30 is in proximity to a channel member 96. Detector 162 is connected to a demodulator or Schmitt trigger 166, providing an output having a step-function transition when the output of the detector 164 changes from a first level to a second level. Such a transition is necessary to provide a rapid switching of current in an inductive discharge type ignition system to provide an ignition pulse. Schmitt trigger 166 is connected to switching means 168, which functions as a current amplifier. Switching means 168 is connected to ignition coils 170 and 172, which, in turn are connected to spark plugs 174 and 176 in an associated engine. Such a system may be constructed in accordance with the teaching of numerous patents, including U.S. Pat. No. 3,316,448, issued to Hardin et al, Apr. 25, 1967, U.S. Pat. No. 3,473,110, issued to Hardin et al, Oct. 14, 1969, U.S. Pat. No. 4,126,112, issued to Tershak, Nov. 21, 1978, and others, as well as by use of commercially-available components performing the functions shown in FIG. 10.

As will be apparent to one skilled in the relevant art, numerous modifications and variations of the disclosed embodiment of the invention may be made without departing from the spirit and scope of the invention.

I claim:

1. An ignition controller, comprising:

a rotatable shaft;

trigger rotor means operably connected to said shaft and movable therewith;

carrier means for supporting a sensing means;

said sensing means being affixed to said carrier means, and supplying an ignition control signal responsive to rotation of said shaft;

said carrier means including means for rotatably engaging said shaft and being located thereby;

whereby said trigger rotor means and said sensing means are referenced to said shaft and to each other;

said trigger rotor means including a first disk portion, said disk portion having a first wall portion perpendicular thereto peripheral to said disk portion and having a second wall portion protruding therefrom parallel to said first wall portion;

a portion of said disk portion and an inner surface of said first wall portion and outer surface of said second wall portion defining an annular groove; and a metallic portion being disposed in said annular groove.

2. An ignition controller according to claim 1, wherein:

said metallic portion in said annular groove conforms to a portion of said annular groove.

3. An ignition controller according to claim 2, wherein:

said metallic portion is embedded in said portion of said disk portion and a portion of said inner surface of said first wall portion and a portion of said outer surface of said second wall portion.

4. An ignition controller according to claim 1, wherein:

said ignition controller includes an advance means for supplying an ignition advance interposed between said shaft and said trigger rotor;

said trigger rotor means includes at least facing involute profile portions of two gear teeth;

said advance means includes mounting means affixed to said shaft;

said mounting means having weight means pivotally mounted thereto and resiliently restrained thereon, said weight means rotating about said pivotal mounting in response to rotation of said rotatable shaft;

said weight means having at least one involute profile gear tooth thereon adapted to mesh with said facing involute profile portions of said trigger rotor means;

said trigger rotor means being rotated around an axis of said shaft by said gear tooth of said weight means rotating about said pivotal mounting in response to rotation of said shaft and acting upon at least one said facing involute profile portion of said trigger rotor means;

said advance means including two said weights, said weights being resiliently restrained by two substantially identical springs, said weights being urged to rotate outwardly in response to rotation of said rotary means;

said advance means including a third spring means;

said weights contacting said third spring means when said rotatable shaft is rotated faster than a predetermined rate;

said third spring means being rotatably mounted about said rotatable shaft;

said third spring means including a first portion for resiliently contacting a first one of said two weights, and a second portion for resiliently contacting a second one of said two weights when said rotatable shaft is rotated faster than a predetermined rate;

whereby said substantially identical springs define a first portion of an advance curve, and said third spring means defines a second portion of said advance curve.

5. An ignition controller comprising:

a rotatable shaft;

trigger rotor means operably connected to said shaft and movable therewith;

carrier means for supporting a sensing means;

said sensing means being affixed to said carrier means, and supplying an ignition control signal responsive to rotation of said shaft;

said carrier means including means for rotatably engaging said shaft and being located thereby, said trigger rotor means and said sensing means being referenced to said shaft and to each other;

said trigger rotor means including a first disk portion, said disk portion having a first wall portion perpendicular thereto peripheral to said disk portion and having a second wall portion protruding therefrom parallel to said first wall portion;

a portion of said disk portion and an inner surface of said first wall portion and outer surface of said second wall portion defining an annular groove;

a metallic portion being disposed in said annular groove;

said metallic portion in said annular groove conforming to a portion of said annular groove and being embedded in said portion of said disk portion and a portion of said inner surface of said first wall portion and a portion of said outer surface of said second wall portion;

said ignition controller includes an advance means for supplying an ignition advance interposed between said shaft and said trigger rotor;

said trigger rotor means including at least facing involute profile portions of two gear teeth;

said advance means including mounting means affixed to said shaft;

said mounting means having weight means pivotably mounted thereto and resiliently restrained thereon, said weight means rotating about said pivotable mounting in response to rotation of said rotatable shaft;

said weight means having at least one involute profile gear tooth thereon adapted to mesh with said facing involute profile portions of said trigger rotor means;

said trigger rotor means being rotated about an axis of said shaft by said gear tooth of said weight means rotating about said pivotal mounting in response to rotation of said shaft and acting upon at least one said facing involute profile portion of said trigger rotor means;

said advance means including two said weights, said weights being resiliently restrained by two substantially identical springs, said weights being urged to rotate outwardly in response to rotation of said rotary means;

said advance means including a third spring means;

said weights contacting said third spring means when said rotatable shaft is rotated faster than a predetermined rate;

said third spring means being rotatably mounted about said rotatable shaft;

said third spring means including a first portion for resiliently contacting one said weight, and a second portion for resiliently contacting a second said weight when said rotatable shaft is rotated faster than a predetermined rate;

said third spring means being loosely mounted to said mounting means to allow said third spring means to be centered between two said weights when contacting said weights;

whereby said substantially identical springs define a first portion of an ignition advance curve, and said third spring means defines a second portion of said advance curve.

6. An ignition controller, comprising:

a rotatable shaft;

trigger rotor means operably connected to said shaft and movable therewith;

said trigger rotor means including a first disk portion, said disk portion having a first wall portion perpendicular thereto peripheral to said disk portion and having a second wall portion protruding from said disk portion parallel to said first wall portion;

a portion of said disk portion and an inner surface of said first wall portion and an outer surface of said second wall portion defining an annular groove;

at least one metallic portion being fixedly disposed in said annular groove; and sensing means for supplying an ignition control signal responsive to said metallic portion being disposed adjacent said trigger rotor means.

7. An ignition controller, comprising:

a rotatable shaft;

trigger rotor means operably connected to said rotatable shaft and movable at least in part therewith;

cover means for enclosing said ignition controller;

carrier means affixed to said cover means;

sensing means for supplying an ignition control signal in response to rotation of said rotor affixed to said carrier means;

said carrier means including means for rotatably engaging said rotatable shaft and for being located thereby.

8. An ignition controller, comprising:

a rotatable shaft;

trigger rotor means operably connected to said shaft and movable therewith;

an ignition advance means mechanically interposed between said shaft and said trigger rotor means;

sensing means responsive to said trigger rotor means for supplying an ignition control signal responsive to rotation of said shaft;

said advance means including mounting means affixed to said shaft;

said mounting means having weight means pivotably mounted thereto and resiliently restrained thereon, said weight means rotating about said pivotal mounting in response to rotation of said rotatable shaft;

said trigger rotor means being rotated around an axis of said shaft by said weight means rotating about said pivotal mounting in response to rotation of said shaft;

said advance means including two said weights, said weights being resiliently restrained by two substantially identical springs, said weights being urged to rotate outwardly in response to rotation of said shaft;

said weights contacting a third springs means when said rotatable shaft is rotated faster than a predetermined rate;

said third spring means being rotatably mounted about said rotatable shaft;

said mounting means including means for mounting said third spring means;

said third spring means including a first portion for resiliently contacting one said weight and a second portion for resiliently contacting a second said weight when said rotatable shaft is rotated faster than said predetermined rate;

said third spring means being loosely mounted to said mounting means to allow said third spring means to be centered between two said weights when contacting said weights;

whereby said substantially identical springs define a first portion of an ignition advance curve, and said third spring means defines a second portion of said advance curve.

9. A trigger rotor for use in an ignition controller, wherein said trigger rotor includes:

a disk-shaped portion adapted to be connected to a rotating shaft of said ignition controller;

said disk portion having a first wall portion perpendicular thereto peripheral to said disk portion and having a second wall portion protruding from said disk portion and parallel to said first wall, a portion of said disk and an inner surface of said first wall section and an outer surface of said second wall portion defining an annular groove;

at least one metallic portion being fixedly disposed in said annular groove.

10. A trigger rotor according to claim 9, wherein:

said metallic portion in said annular groove conforms to a portion of said annular groove.

11. A trigger rotor according to claim 10, wherein:

said metallic portion is embedded in a portion of said disk portion and a portion of said inner surface of said first wall portion and a portion of said outer surface of said second wall portion.

* * * * *

UNITED STATES PATENT AND TRADEMARK OFFICE

CERTIFICATE OF CORRECTION

PATENT NO. : 4,333,433

DATED : June 8, 1982

INVENTOR(S) : Richard W. Mattson

It is certified that error appears in the above—identified patent and that said Letters Patent is hereby corrected as shown below:

Column 2, line 8, change "shift" to -- shaft --.

Signed and Sealed this

*Twenth-eighth* Day of *September 1982*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,333,433

DATED : June 8, 1982

INVENTOR(S) : Richard W. Mattson

It is certified that error appears in the above-identified patent and that said Letters Patent are hereby corrected as shown below:

Column 1, line 19, after "interruption" insert --of--;
line 41, before "elements", change "ajoining" to --adjoining--;
line 59, before "always", change "is" to --it--.

line 11, before "advantage" insert --an--;
line 20, change "comforming" to --conforming--;
line 30, change "numbers" to --number--;
line 42, before "further" insert --a--.
Column 3, line 60, change "a" to --an--.
Column 4, line 26, change "suppling" to --supplying--;
line 27, before "ignition", change "a" to --an--;
line 49, change "member" to --members--.
Column 5, line 2, change "according" to --accordance--;
line 32, change "system" to --systems--.
Column 6, line 48, before "instance" delete "a".

Signed and Sealed this

Fourteenth Day of August 1984

[SEAL]

Attest:

GERALD J. MOSSINGHOFF

Attesting Officer

Commissioner of Patents and Trademarks